US007219605B2

(12) United States Patent
Nishiyama et al.

(10) Patent No.: US 7,219,605 B2
(45) Date of Patent: May 22, 2007

(54) CYLINDER CLEANING APPARATUS

(75) Inventors: Eizo Nishiyama, Tokyo (JP); Kazuhiro Yoshida, Shizuoka (JP)

(73) Assignee: Baldwin-Japan, Ltd., Tokyo (JP)

( * ) Notice: Subject to any disclaimer, the term of this patent is extended or adjusted under 35 U.S.C. 154(b) by 0 days.

(21) Appl. No.: 10/865,953

(22) Filed: Jun. 11, 2004

(65) Prior Publication Data

US 2004/0250721 A1 Dec. 16, 2004

(30) Foreign Application Priority Data

Jun. 12, 2003 (JP) ..... 2003-167268

(51) Int. Cl.
*B41F 35/00* (2006.01)

(52) U.S. Cl. ..... 101/424; 101/425

(58) Field of Classification Search ..... 101/423–425; 15/256.53, 256.51, 256.52, 256; 134/22.12
See application file for complete search history.

(56) References Cited

U.S. PATENT DOCUMENTS

| | | | | |
|---|---|---|---|---|
| 3,952,654 | A * | 4/1976 | Evans | 101/425 |
| 4,003,276 | A * | 1/1977 | Schmitt | 83/100 |
| 4,193,552 | A | 3/1980 | Ishikawa | |
| 4,205,911 | A * | 6/1980 | Dole | 399/355 |
| 4,311,094 | A * | 1/1982 | Ellison | 101/425 |
| 4,497,250 | A * | 2/1985 | Dressler | 101/350.5 |
| 4,747,348 | A * | 5/1988 | Jeschke et al. | 101/425 |
| 4,954,179 | A * | 9/1990 | Franninge | 134/22.12 |
| 5,010,819 | A * | 4/1991 | Uribe et al. | 101/425 |
| 5,035,178 | A * | 7/1991 | Jahn et al. | 101/425 |
| 5,109,770 | A | 5/1992 | Uribe et al. | 101/425 |
| 5,291,259 | A * | 3/1994 | Weitzel et al. | 399/356 |
| 5,732,631 | A * | 3/1998 | Walther et al. | 101/424 |
| 5,870,952 | A * | 2/1999 | Eichner et al. | 101/148 |
| 5,887,524 | A * | 3/1999 | Seefried | 101/424 |
| 5,953,994 | A * | 9/1999 | Seefried | 101/424 |
| 6,125,754 | A * | 10/2000 | Harris | 101/420 |
| 6,196,126 | B1 * | 3/2001 | Smith et al. | 101/114 |
| 6,484,636 | B1 * | 11/2002 | Seefried | 101/425 |
| 6,601,510 | B1 * | 8/2003 | Michalik et al. | 101/425 |
| 2002/0157205 | A1 | 10/2002 | Hara | |

FOREIGN PATENT DOCUMENTS

DE 21 59 115 A1 6/1972

(Continued)

OTHER PUBLICATIONS

European Search Report dated Apr. 6, 2006.

*Primary Examiner*—Anthony H. Nguyen
(74) *Attorney, Agent, or Firm*—Morgan & Finnegan LLP

(57) ABSTRACT

An apparatus is arranged to clean a cylinder with cleaning liquid being supplied. The cylinder includes an outer surface to which impurities are adhered. The impurities are removed from the outer surface when cleaning. The apparatus includes a spray bar into which the cleaning liquid is directed with pressure. The spray bar comprises tube means which includes nozzle holes formed therein for spouting the cleaning liquid. The tube means is formed of elastic material and elastically deformed by the pressure of cleaning liquid to open the nozzle holes and spout the cleaning liquid. The tube means is elastically restored, when the cleaning liquid is not directed with pressure into the spray bar, to close the nozzle holes.

7 Claims, 9 Drawing Sheets

FOREIGN PATENT DOCUMENTS

| | | | | |
|---|---|---|---|---|
| DE | 296 12 400 | U1 | | 9/1996 |
| DE | 298 19 374 | U1 | | 2/1999 |
| DE | 100 27 021 | A1 | | 1/2002 |
| EP | 0 747 219 | A | | 12/1996 |
| EP | 0 844 085 | A | | 5/1998 |
| EP | 0 878 304 | A | | 11/1998 |
| EP | 0 928 687 | A | | 7/1999 |
| EP | 1 106 354 | A | | 6/2001 |
| FR | 1 351 365 | A | | 2/1964 |
| GB | 1357623 | A | * | 6/1974 |
| JP | 402251204 | A | * | 10/1990 |

* cited by examiner

CYLINDER CLEANING APPARATUS

FIELD OF THE INVENTION

The invention relates to an apparatus for cleaning a cylinder in an offset printing press, other printing press, paper making machine, paper converting machine, textile machinery or the like. The cylinder includes an outer surface to which impurities are adhered. The impurities are removed from the outer surface when cleaning.

PRIOR ART

For example, impurities such as dried ink, lint and the like are adhered to the outer surface of cylinder in an offset printing press or other printing press. It is therefore required to clean the cylinder at intervals to keep each of printed products having a good quality.

Under the circumstances, an apparatus has heretofore been commercially available to clean the cylinder with cleaning liquid being supplied, as disclosed in U.S. Pat. No. 5,109,770. In the apparatus of U.S. Patent, the cleaning liquid is directed with pressure into a spray bar. The spray bar comprises a tube which includes nozzle holes formed therein and orientated toward a brush roller for spouting the cleaning liquid. The brush roller is brought into contact with the cylinder and rotated in a direction so that the impurities can be removed from the outer surface of cylinder by the brush roller.

In addition, the apparatus includes a tray disposed beneath the brush roller so that effluent can be received in the tray. The effluent contains the impurities removed from the outer surface of cylinder, besides the cleaning liquid. The apparatus further includes a flipper but extending parallel to and spaced from the brush roller. The flipper bar can be moved for positional adjustment to be brought into contact with the brush roller so that the effluent can be tipped from the brush roller by the flipper bar to clean the brush roller after cleaning the cylinder.

However, the apparatus has the following problems.

First, the nozzle holes must be formed in the spray bar comprising the tube by using a drilling or laser apparatus which is expensive, to be high in cost. Furthermore, it is difficult to prevent dust from flowing into the nozzle holes when not spouting the cleaning liquid. The nozzle holes may therefore be clogged with the dust.

Second, the flipper bar must be made of rigid material otherwise it will wear by being brought into contact with the brush roller. The flipper bar must therefore be heavy, making it troublesome to handle. In addition, it is unsatisfactory to merely clean the brush roller after cleaning the cylinder. It is desired to additionally make the effluent flipped from the brush roller by the flipper bar when cleaning the cylinder. Furthermore, in this case, the flipper bar must be exposed to the effluent. The apparatus is therefore problematic in sludge grown from the effluent and adhered to and deposited on the flipper bar.

Third, the cleaning liquid must generate mist when cleaning the cylinder. The mist may leak out of the apparatus, causing environmental pollution. It is difficult to prevent the mist from leaking even if making the brush roller disposed in a space denied by a frame and sealing it and the cylinder with conventional means.

Last, the tray must be filled with the effluent within a short period of few days. Accordingly, an operator has to detach and convey the tray from the apparatus frequently to pour the effluent into a receptacle from the tray without spilling the effluent. In addition, it is required to clean the tray of sludge grown from the effluent. The operator is therefore forced to do dirty work, taking labors and times. The work is very hard especially in the apparatus including many brush rollers and trays.

In this connection, the tray can be connected to the receptacle by means of a drainpipe to drain the effluent into the receptacle from the tray through the drainpipe. However, the drainpipe may be clogged with sludge grown from the effluent and adhered to and deposited on the inner surface of drainpipe. The effluent can therefore overflow the tray due to lack of drainage. Accordingly, the operator has to clean the drainpipe clogged with the sludge, taking labors and times. It may be required to exchange the drainpipe for new one.

It is therefore an object of the invention to provide a new and improved apparatus for cleaning a cylinder with cleaning liquid being supplied, so as to thereby overcome the above problems. The cylinder includes an outer surface in which impurities are adhered. The impurities are removed from the outer surface when cleaning.

Other object of the invention is to provide the apparatus including a spray bar comprising tube means which includes nozzle holes formed therein for spouting the cleaning liquid, the spray bar being low in cost.

Other object of the invention is to provide the apparatus which is arranged to prevent dust from flowing into the nozzle holes when not spouting the cleaning liquid.

Other object of the invention is to provide the apparatus including a brush roller by which the impurities are removed from the outer surface of cylinder and a flipper bar extending parallel to the brush roller, the apparatus being arranged to lighten the flipper bar, making it easy to handle.

Other object of the invention is to provide the apparatus which is arranged to make effluent flipped from the brush roller by the flipper bar when cleaning the cylinder, and make the effluent flipped from the brush roller by the flipper bar to clean the brush roller after cleaning the cylinder.

Other object of the invention is to provide the apparatus which is arranged to prevent sludge from being grown from the effluent end adhered to and deposited on the flipper bar.

Other object of the invention is to provide the apparatus in which the cleaning liquid generates mist, the apparatus being arranged to prevent the mist from leaking out of the apparatus, without causing environmental pollution.

Other object or the invention is to provide the apparatus including a tray disposed beneath the brush roller so that effluent can be received in the tray, the apparatus being arranged to prevent the tray from being filled with the effluent within a short period.

Other object of the invention is to provide the apparatus which is arranged to prevent a drainpipe from being clogged with sludge grown from the effluent and adhered to and deposited on the inner surface of drainpipe when the tray is connected with a receptacle by means of the drainpipe.

SUMMARY OF THE INVENTION

According to the invention, the apparatus includes a spray bar into which the cleaning liquid is directed with pressure. The spray bar comprises tube means which includes nozzle holes formed therein for spouting the cleaning liquid. The tube means is formed of elastic material and elastically deformed by the pressure of cleaning liquid to open the nozzle holes and spout the cleaning liquid. The tube means is elastically restored, when the cleaning liquid is not directed with pressure into the spray bar, to close the nozzle holes.

In a preferred embodiment, the tube means comprises a plurality of tubes formed of elastic material throughout thereof and including the nozzle holes formed therein respectively. The tubes are arranged side by side and joined integrally with each other.

The tube means may be formed of elastic material partially to include at least a portion formed of elastic material. The nozzle holes are formed in the portion.

The nozzle holes comprise pinholes each of which is formed in the tube means by a needle piercing the tube means.

The apparatus further includes a brush roller by which the impurities are removed from the outer surface of cylinder. The tubes include the nozzle holes orientated toward the brush roller for spouting the cleaning liquid.

The cleaning liquid comprises solvent and/or water.

The apparatus further includes a flipper bar extending parallel to the brush roller. The flipper bar includes a rigid portion brought into contact with the brush roller. At least one of the tubes includes the nozzle holes orientated toward the rigid portion for spouting the cleaning liquid.

The apparatus further includes positional adjustment means by which the flipper bar is moved for positional adjustment between a first position in which the rigid portion intrudes into the brush roller shallowly so that effluent can be flipped from the brush roller by the rigid portion when cleaning the cylinder, and a second position in which the rigid portion intrudes into the brush roller deeply so that the effluent can be flipped from the brush roller by the rigid portion to clean the brush roller after cleaning the cylinder.

The flipper bar has a circular cross section and includes a flat surface cutting off the cross section and extending longitudinally of the flipper bar. The rigid portion comprises a plate fixed to the flat surface.

The brush roller is rotated in a direction. The rigid portion extends substantially tangentially to the brush roller and includes an end portion which is positioned downstream of the rigid portion in the direction and brought into contact with the brush roller.

The brush roller is disposed in a space defined in a frame, the cleaning liquid generating mist. The apparatus further includes suction means for sucking the mist of cleaning liquid floating in the space. The apparatus further includes condensation means for collecting the mist to condense it into liquid.

The apparatus further includes a tray disposed beneath the brush roller so that the effluent can be received in the tray. The effluent contains the impurities removed from the outer surface of cylinder. The tray includes openings formed therein so that the effluent can pass through the openings to be discharged from the tray after being separated from solid or particulate material.

The brush roller has opposite end portions disposed at positions predetermined axially of the brush roller. The openings are formed outwardly of the positions of opposite end portions of brush roller.

The tray is mounted on the frame for removal. The tray includes a first portion in which the effluent is received. The tray further includes a second portion disposed adjacent the first portion. The condensation means condenses the mist into liquid which is then discharged from the condensation means and received in the second portion. The tray further includes a partition disposed between the first and second portions. The partition includes the openings formed at opposite end portions thereof so that the effluent can pass through the openings to be discharged from the first portion and received in the second portion after being separated from solid or particulate material by the partition.

BRIEF DESCRIPTION OF DRAWINGS

FIG. 8 is an elevational view of the spray bar of FIG. 1.

DETAILED DESCRIPTION OF THE PREFERRED EMBODIMENTS

Figure 1:
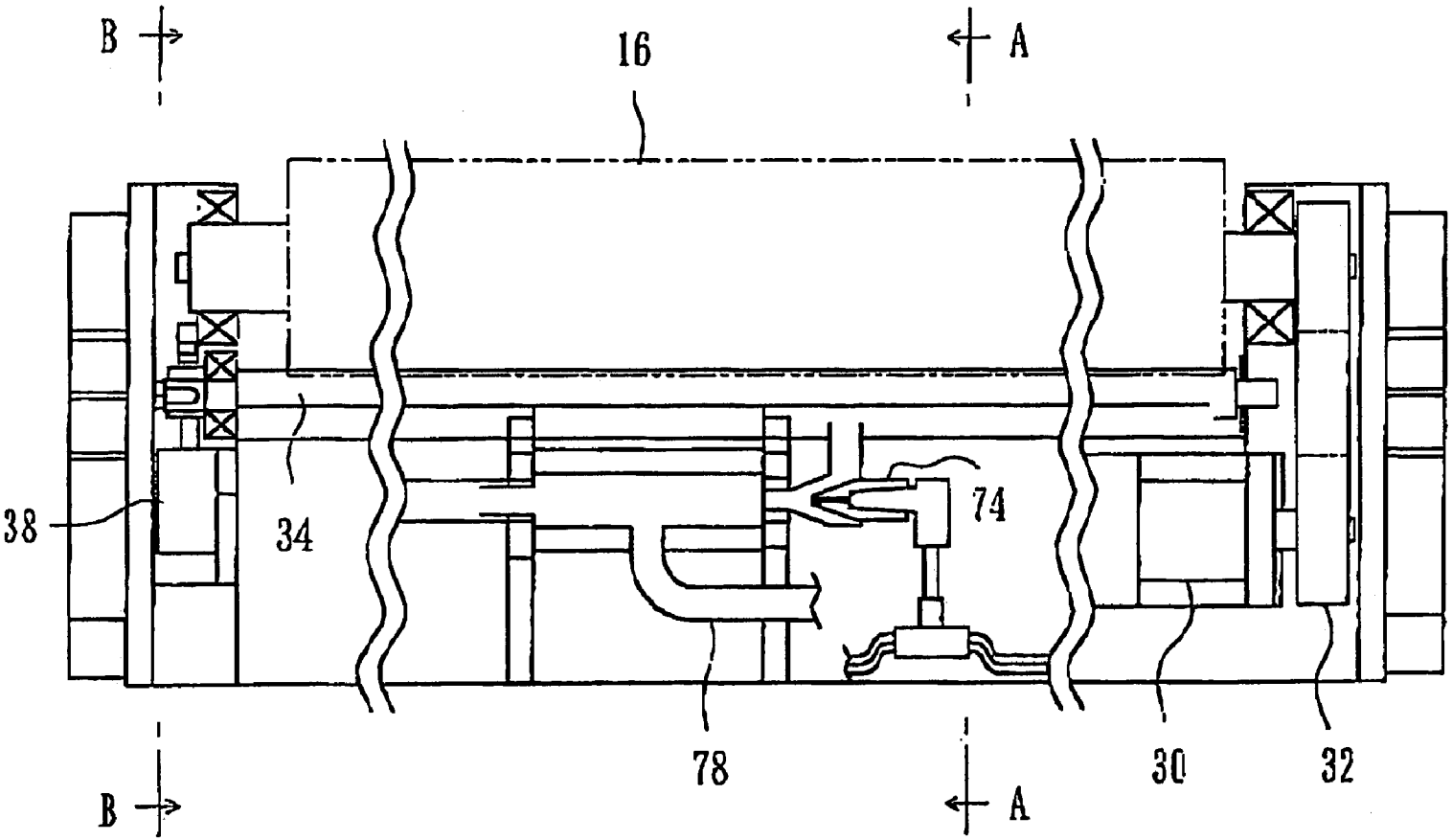
FIG. 1 is a plan view of a preferred embodiment of the invention.
Figure 2:
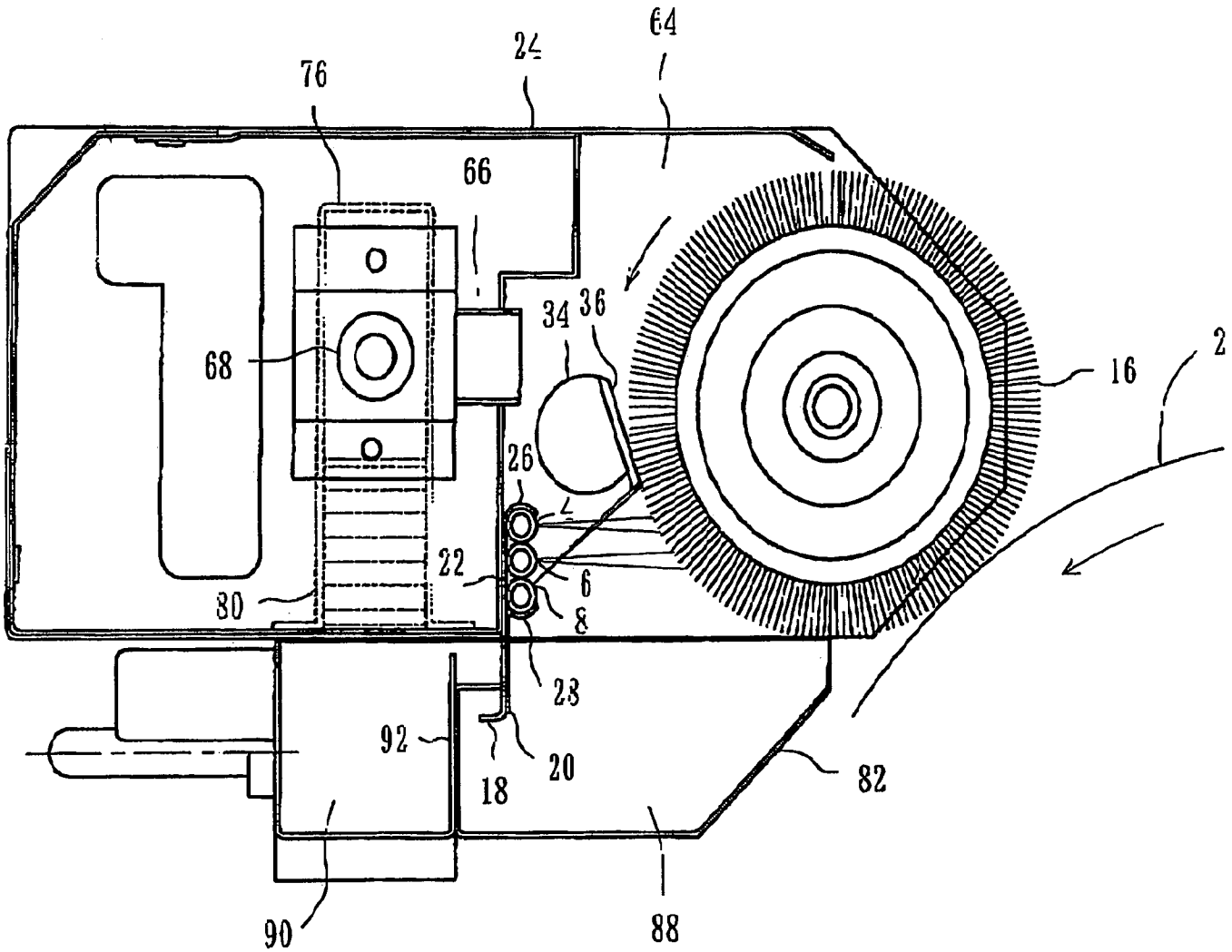
FIG. 2 is a cross sectional view of the apparatus of FIG. 1 taken along a line A—A.

Turning now to the drawings. FIG. 1 illustrates an apparatus for cleaning a cylinder 2 in an offset printing press or other printing press, as shown in FIG. 2, with cleaning liquid being supplied, according to the invention. The cylinder 2 includes an outer surface to which impurities such as dried ink, lint and the like are adhered. The impurities are removed from the outer surface when cleaning.

Figure 8:
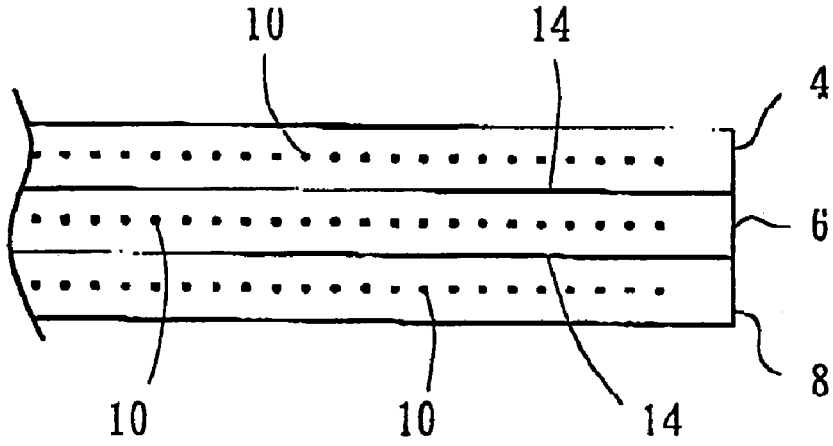
FIG. 8 is a right side view of the tray of FIG. 3.
Figure 9:
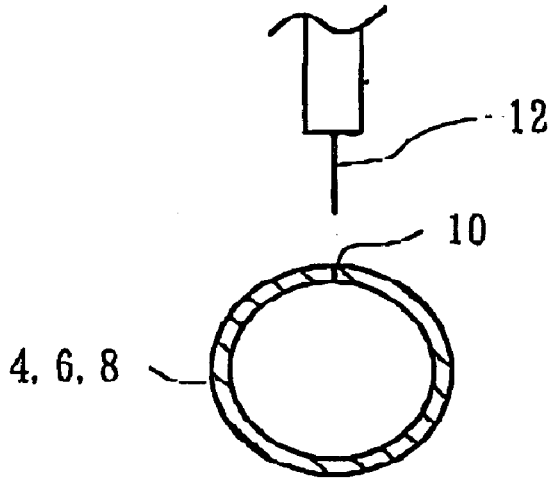
FIG. 9 is an explanatory view of a needle by which the nozzle holes are formed in the spray bar of FIG. 8.
Figure 10:
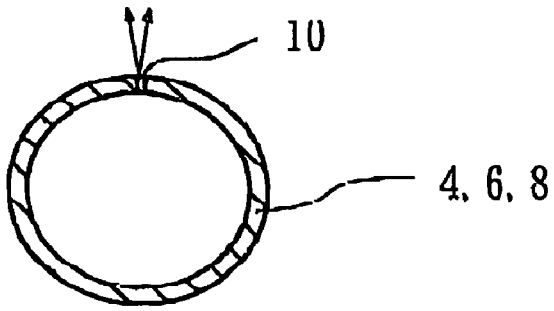
FIG. 10 is an explanatory view of the spray bar of FIG. 8 when being elastically deformed by the pressure of cleaning liquid to open the nozzle holes.

The apparatus includes a spray bar into which the cleaning liquid is directed with pressure. The spray bar comprises tube means 4, 6 and 8 which includes nozzle holes 10 formed therein for spouting the cleaning liquid, as shown in FIG. 8. The tube means 4, 6 and 8 is formed of elastic and flexible material such as polyurethane, nylon, fluorine resin (Teflon), silicon rubber, polyethylene or other high polymer. The nozzle holes 10 comprises pinholes each of which is formed in the tube means 4, 6 and 8 by a needle 12 piercing the tube means 4, 6 and 8, as shown in FIG. 9. Accordingly, the tube means 4, 6 and 8 can be elastically deformed by the pressure of cleaning liquid directed into the spray bar, to increase in diameter, open the nozzle holes 10 and spout the cleaning liquid, as shown in FIG. 10. The tube means 4, 6 and 8 can also be elastically restored, when the cleaning liquid is not directed with pressure into the spray bar, to decrease in diameter and close the nozzle holes 10.

It should therefore be recognized in the apparatus that the nozzle holes 10 can be formed in the spray bar comprising the tube means 4, 6 and 8 without using a drilling or laser apparatus which is expensive, to be low in cost. Furthermore, the tube means 4, 6 and 8 can close the nozzle holes 10 to prevent dust from flowing into the nozzle holes 10 when not spouting the cleaning liquid. The nozzle holes 10 are therefore not clogged with the dust.

The tube means 4, 6 and 8 comprises a plurality of tubes formed of elastic and flexible material throughout thereof and including the nozzle holes 10 formed therein respectively. The tubes 4, 6 and 8 are arranged side by side and joined integrally with each other. In the embodiment, three tubes 4, 6 and 8 are arranged side by side. The tubes 4, 6 and 8 are then heated and pressed by appropriate means to be joined integrally with each other so that joined portions 14 can be formed between the tubes 4, 6 and 8.

The apparatus further includes a brush roller 16 by which the impurities are removed from the outer surface of cylinder 2. The tubes 4, 6 and 8 are disposed above and below and supported by means of a pair of fixtures 18 and 20 to extend parallel to the brush roller 16. The tubes 4 and 6 include the nozzle holes 10 orientated toward the brush roller 16 for spouting the cleaning liquid. The cleaning liquid comprises solvent and/or water.

The tube 4 is the upper one disposed on the upper side of the tube 6 which is the middle one. The tube 8 is the lower one disposed on the lower side of the tube 6. The fixture 18 is fixed to a partition 22 comprising a vertical wall which is fixed to a frame 24. The fixture 20 is mounted on the fixture 18 for vertical movement. In addition, the fixture 18 includes an end portion 26 which is arc-shaped to be engaged with the tube 4 while the fixture 20 includes an end portion 28 which is arc-shaped to be engaged with the tube 8. The tubes 4, 6 and 8 can therefore be clamped between and supported by the end portions 26 and 28 when the fixture 20 is moved along the fixture 18 upwardly after the tubes 4, 6 and 8 are interposed between the end portions 26 and 28. The fixture 20 is then fixed to the texture 18 by screws.

The cylinder 2 is rotated in a direction when cleaning. The brush roller 16 is brought into contact with the cylinder 2 and rotated in a direction. In the embodiment, the cylinder 2 is rotated counterclockwise in FIG. 2 when cleaning. The brush roller 16 is brought into contact with the cylinder 2 and rotated counterclockwise in FIG. 2. In this connection, the brush roller 16 is connected to and rotated by a motor 30 through a belt 32. In addition, the tubes 4 and 6 spout the cleaning liquid toward the brush roller 16 so that the impurities can be removed from the outer surface of the cylinder 2 by the brush roller 16.

The apparatus further includes a flipper bar 34 extending parallel to the brush roller 10. As to the flipper bar 34, it is desired to make effluent flipped from the brush roller 15 by the flipper bar 34 when cleaning the cylinder 2. It is also desired to make the effluent flipped from the brush roller 16 by the flipper bar 34 to clean the brush roller 16 after cleaning the cylinder 2.

Under the circumstances, the flipper bar 34 includes a rigid portion 36 brought into contact with the brush roller 16. At least one of the tubes a includes the nozzle holes 10 orientated toward the rigid portion 36 for spouting the cleaning liquid.

Accordingly, the flipper bar 34 is not required to be made of rigid material except the rigid portion 36. This can lighten the flipper bar 34, making it easy to handle.

Figure 13:
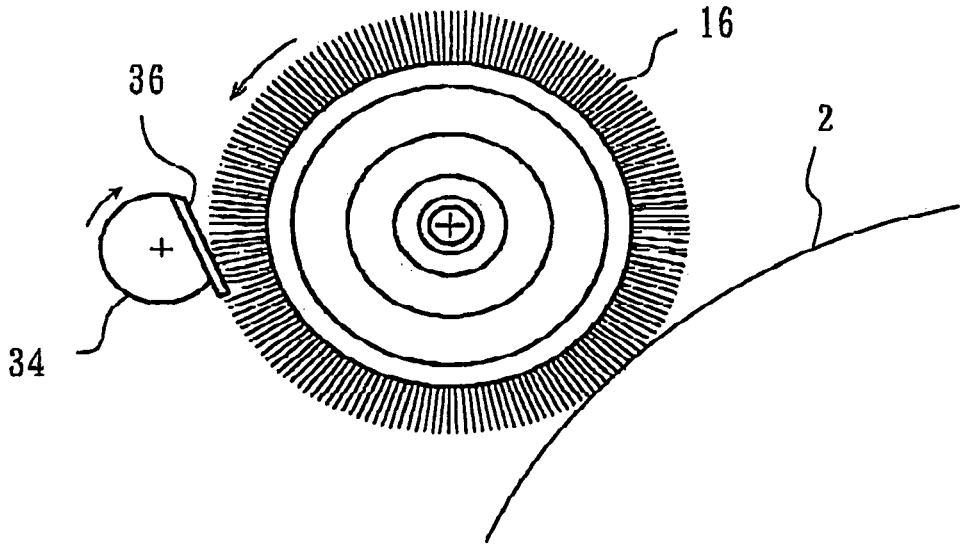
FIG. 13 is a cross sectional view of the flipper bar of FIG. 2 with the rigid portion intruding into the brush roller shallowly.
Figure 14:
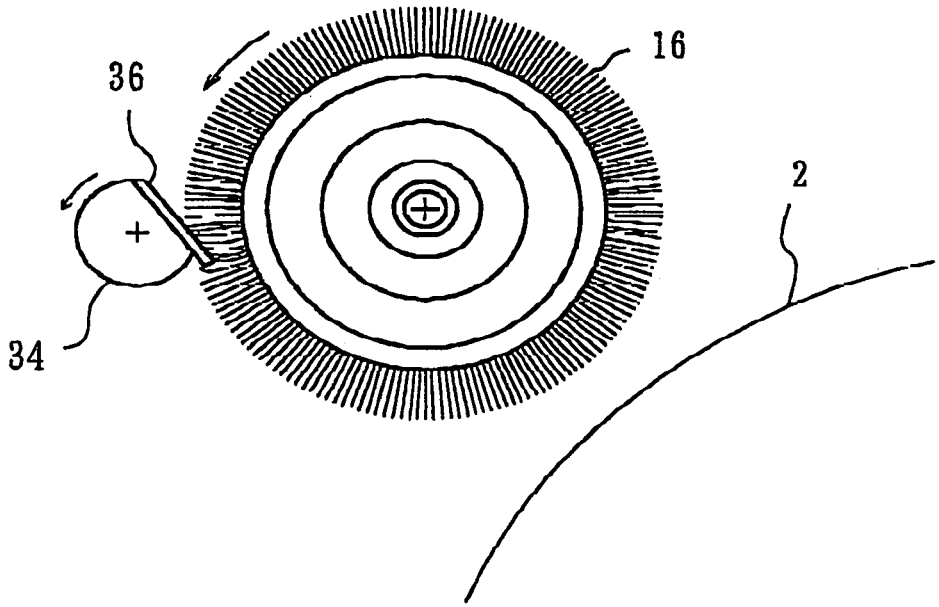
FIG. 14 is a cross sectional view of the flipper bar of FIG. 2 with the rigid portion intruding into the brush roller deeply.

The apparatus further includes positional adjustment means by which the flipper bar 34 is moved for positional adjustment between first and second positions. In the first position, the rigid portion 36 intrudes into the brush roller 16 shallowly, as shown in FIG. 13, so that effluent can be flipped from the brush roller 16 by the rigid portion 30 when cleaning the cylinder 2. In the second position, the rigid portion 36 intrudes into the brush roller 15 deeply, as shown in FIG. 14. The tube 8 then spouts the cleaning liquid toward the rigid portion 36. The brush roller 16 is spaced from the cylinder 2 and rotated counterclockwise in FIG. 2 when the rigid portion 36 intrudes into the brush roller 16 deeply so that the effluent can be flipped from the brush roller 16 by the rigid portion 36 to clean the brush roller 15 after cleaning the cylinder 2. In addition, the impurities can be removed from the brush roller 16 by the rigid portion 36 after being removed from the outer surface of cylinder 2 and adhered to the brush roller 16, when cleaning the brush roller 16.

The flipper bar 34 is therefore useful to make the effluent flipped from the brush roller 16 when cleaning the cylinder 2. The flipper bar 34 is also useful to make the effluent flipped from the brush roller 15 to clean the brush roller 16 after cleaning the cylinder 2.

Figure 15:
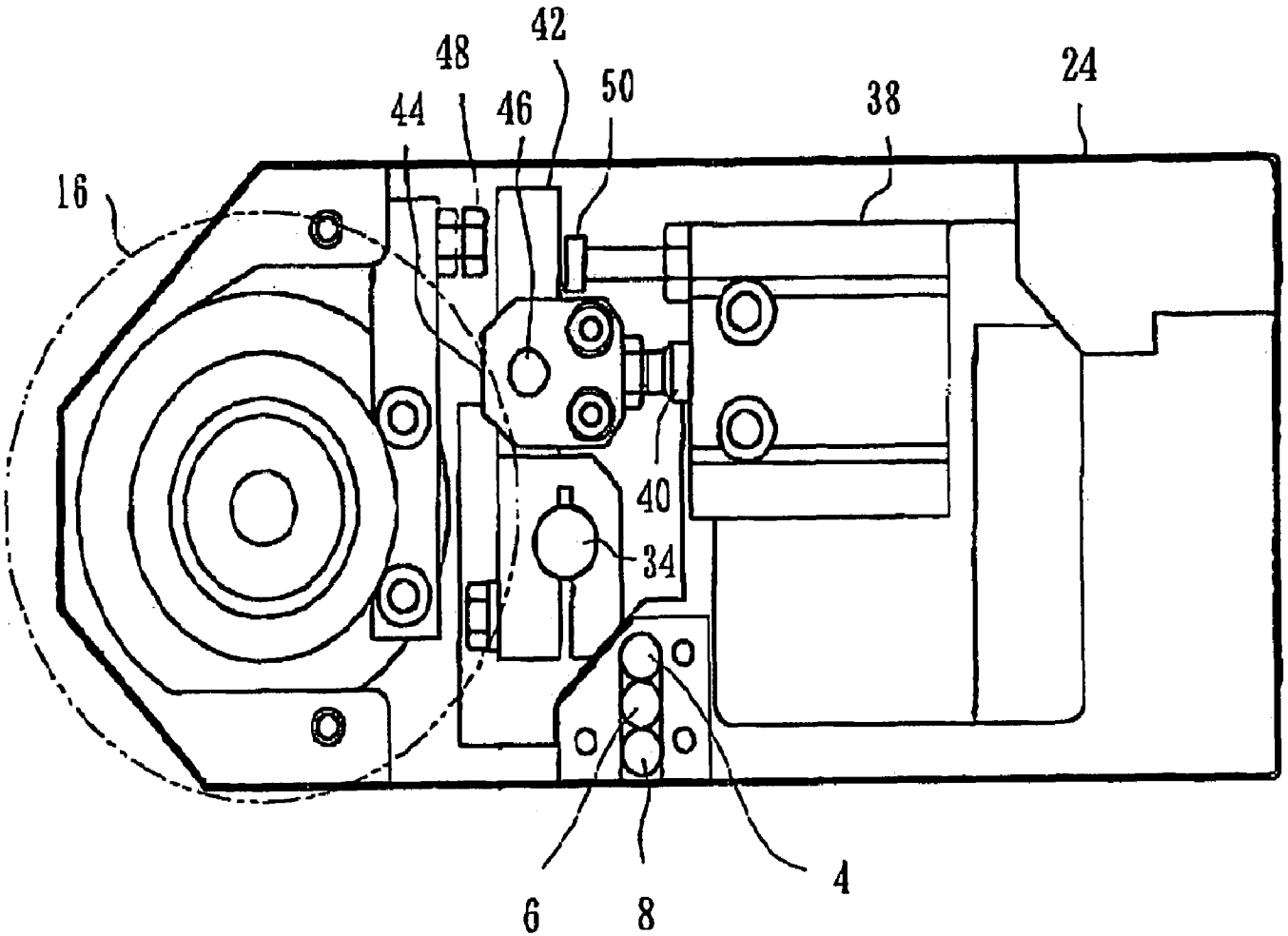
FIG. 15 is a side view at the apparatus at FIG. 1 taken along a line B—B.

The positional adjustment means comprises an air cylinder 38 including a piston rod 40, as shown in FIG. 15. The flipper bar 34 includes an end portion to which a lever 42 is fixed. The piston rod 40 is connected to the lever 42 by a knuckle joint 44 and a pin 46. The lever 42 extends beyond the knuckle joint 44 to be disposed between a pair of stops 48 and 50. The piston rod 40 is advanced from the cylinder 38 so that the lever 42 can be swung about the flipper bar 34 and engaged with and stopped by the stop 48. The flipper bar 34 is rotated integrally with the lever 42 to be moved into the first position in which the rigid portion 36 is intrudes into the brush roller 16 shallowly. The piston 40 is retracted into the cylinder 38 so that the lever 42 can be swung about the flipper bar 34 and engaged with and stopped by the stop 50. The flipper bar 34 is rotated integrally with the lever 42 to be moved into the second position in which the rigid portion 36 is intrudes into the brush roller 16 deeply.

The flipper bar 34 has a circular cross section and includes a flat surface cutting off the cross section and extending longitudinally of the flipper bar 34. The rigid portion 36 comprises a plate fixed to the flat surface.

The brush roller 16 is rotated in a direction, as described above. The rigid portion 36 extends substantially tangentially to the brush roller 16 and includes an end portion which is positioned downstream of the rigid portion 36 in the direction and brought into contact with the brush roller 16.

In this connection, it should be recognized that the effluent is flipped from the brush roller 16 and downstream of the rigid portion 36. The rigid portion 36 is therefore hardly exposed to the effluent flipped from the brush roller 16 by reason that the end portion is positioned downstream of the rigid portion 36 and brought into contact with the brush roller 16. Accordingly, the apparatus can prevent sludge from being grown from the effluent and adhered to and deposited on the rigid portion 36. In addition, the rigid portion 36 comprises the plate which is thin to prevent the sludge from being adhered to the end portion thereof.

The tube means may comprise a single tube formed of elastic and flexible material throughout thereof and including the nozzle holes formed therein.

Figure 11:
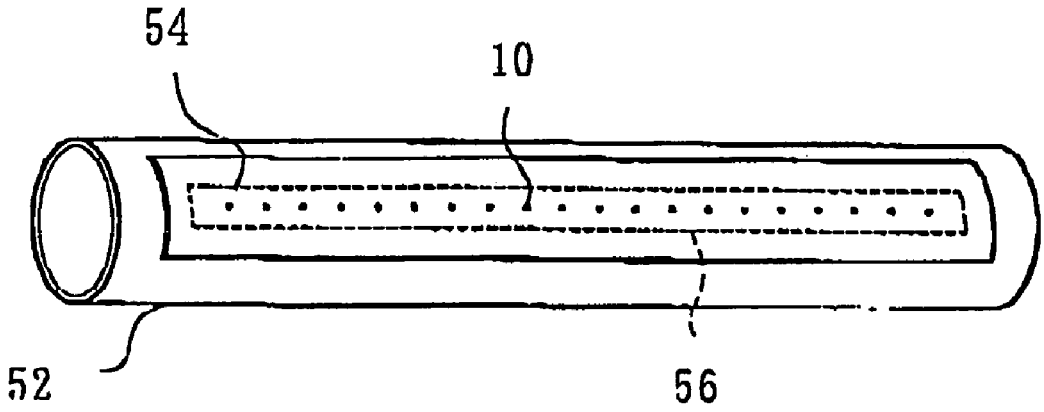
FIG. 11 is a perspective view of other embodiment.
Figure 12:
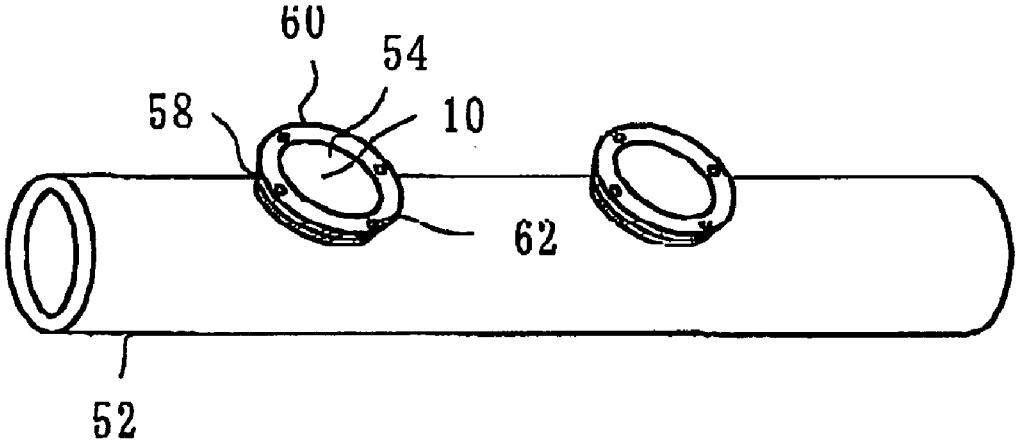
FIG. 12 is a perspective view of other embodiment.

The tube means may be formed of elastic material partially to include at least a portion formed of elastic material, the nozzle holes being formed in the portion. For example, the tube means may comprise a tube 52 formed of rigid material such as metal and a sheet 54 formed of elastic material and pasted on the tube 52, as shown in FIG. 11. The tube 52 includes an opening 56 formed therein and covered with the sheet 54 in which the nozzle holes 10 are formed. The sheet 54 can therefore be elastically deformed by means of the pressure of cleaning liquid to open the nozzle holes 10 and spout the cleaning liquid. The tube 52 may include a plurality of outlets 58 each of which is covered with the sheet 54, as shown in FIG. 12. A fitting 60 may be fixed to the outlet 58 by screws 62 so that the sheet 54 can be clamped between the fitting 60 and the outlet 58. The nozzle holes 10 are formed in the sheets 54.

The flipper bar 34 may be fixed to and supported by arm means which is swung about a pin so that the flipper bar can be moved integrally with the arm means between the first position in which the rigid portion 36 intrudes the brush roller 16 shallowly and the second position in which the rigid portion 36 includes into the brush roller 16 deeply. The flipper bar 34 may be moved linearly between the first and second positions.

Furthermore, the brush roller 16 is disposed in a space 64 defined in the frame 24, the cleaning liquid generating mist. The apparatus further includes suction means for sucking the mist of cleaning liquid floating in the space 64. The apparatus further includes condensation means for collecting the mist to condense it into liquid.

Figure 16:
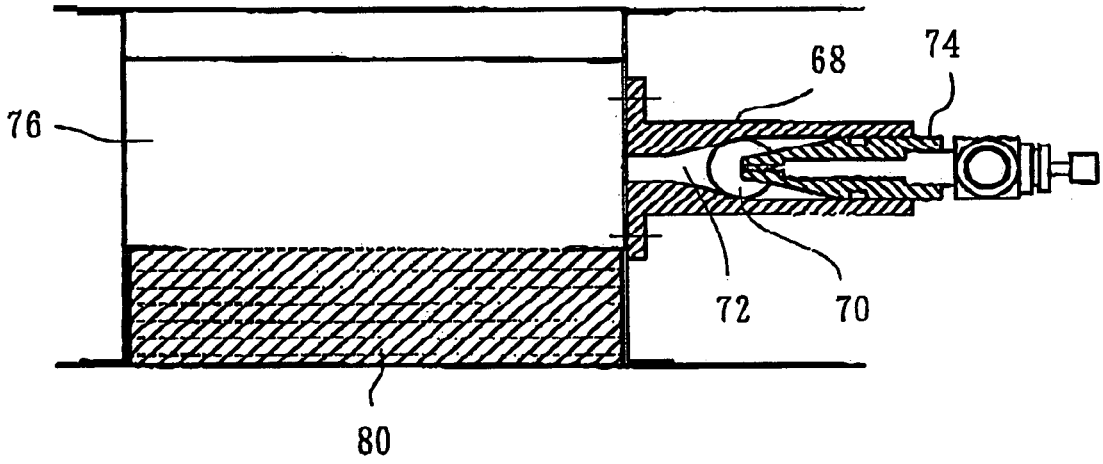
FIG. 16 is a longitudinal sectional view of the suction means and the condensation means of FIG. 1.

In the embodiment, the suction means includes a plurality of suction pipes 66 extending through the partition 22 and opening into the space 64. The suction means further includes a plurality of bocks 68 each of which includes a first flow path 70 formed therein and communicated with the suction pipe 66, as shown in FIG. 16. The block 68 further includes a second flow path 72 formed therein and intersecting the first flow path 70. In addition, a nozzle 74 is disposed in the second flow path 72 on one of the opposite sides of the first flow path 70. The second flow path 72 opens into a chamber 76 on the other side of the first flow path 70. The second flow path 72 opens into the chamber 76 directly in one of the blocks 68 while the second flow path 72 opens into the chamber 76 through a connecting pipe 78 in other blocks 68. Furthermore, the nozzle 74 is connected to a source of air to jet pressurized air across the first flow path 70 and toward the chamber 76 so that a venturi affect can be obtained in the second flow path 72 by the pressurized air to suck the mist of cleaning liquid into the second flow path 72 from the space 64 through the suction pipe 66 and the first flow path 70. The second flow path 72 is throttled toward the chamber 76 so that the mist of cleaning liquid can be discharged into the chamber 76 by the pressurized air.

The condensation means comprises baffle plates or wire clothe 80 received in the chamber 76 below a position in which the second flow paths 72 open into the chamber 76. The chamber 76 is closed at the top thereof while it opens at the bottom thereof so that mist of cleaning liquid can flow downward and through the baffle plate or wire cloths 80. The baffle plate or wire cloths 80 can therefore collect the mist to condense it into liquid.

The apparatus can therefore prevent the mist from leaking out of the apparatus, without causing environmental pollution.

It should be understood in the apparatus that the spray bar 4, 6 and 8, brush roller 16, flipper bar 34, suction means and condensation means are built in the frame 24 to be united into a unit.

Figure 7:
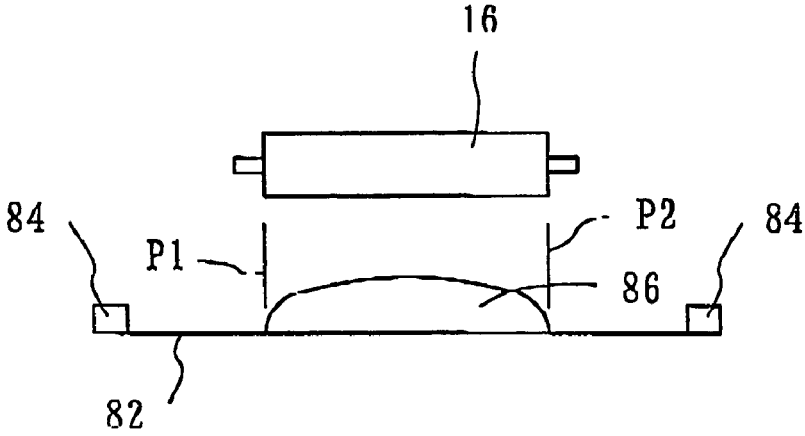
FIG. 7 is an explanatory view of the brush roller and the tray of FIG. 1

The apparatus further includes a tray 82 disposed beneath the brush roller 16 so that effluent can be received in the tray 82. The effluent contains the impurities removed from the outer surface of cylinder 2, besides the cleaning liquid. The tray 82 includes openings 84 formed therein so that the effluent can pass through the openings 84 to be discharged from the tray 82 after being separated from solid or particulate material 86, as shown in FIG. 7.

On the other hand, the brush roller 16 has opposite end portions disposed at positions P1 and P2 predetermined axially of the brush roller 16. The openings 84 are formed outwardly of the positions P1 and P2 of opposite end portions of brush roller 16.

In this connection, it should be recognized that the effluent is flipped from the brush roller 16 between the positions P1 and P2 when cleaning to be received in the tray 82. The effluent then flows toward the openings 84 formed outwardly of the positions P1 and P2 to be separated from the solid or particulate material 86. The solid or particulate material 86 is therefore gradually accumulated on the tray 82 between the positions P1 and P2. The effluent then showers down on the accumulation of solid or particulate material 86 to flow down into and along the accumulation. The effluent is separated from the solid or particulate material 86 when flowing down into and along the accumulation. The solid or particulate materials 86 are adhered to and incorporated into the accumulation.

Accordingly, the effluent contains no solid or particulate material 86 when being discharged from the tray 82. The effluent can therefore be discharged from the tray 82 without difficulty, to prevent the tray 82 from being filled with the effluent.

The tray 82 is mounted on the frame 24 for removal. Accordingly, an operator can detach and convey the tray 82 from the apparatus for cleaning the tray 82 after the solid or particulate material 86 has been accumulated to a certain extent. The solid or particulate material 86 would be accumulated to the extent within a long period of one or two months. It is therefore not required to detach and convey the tray 82 from the apparatus for cleaning the tray 82 for the long period.

Figure 3:
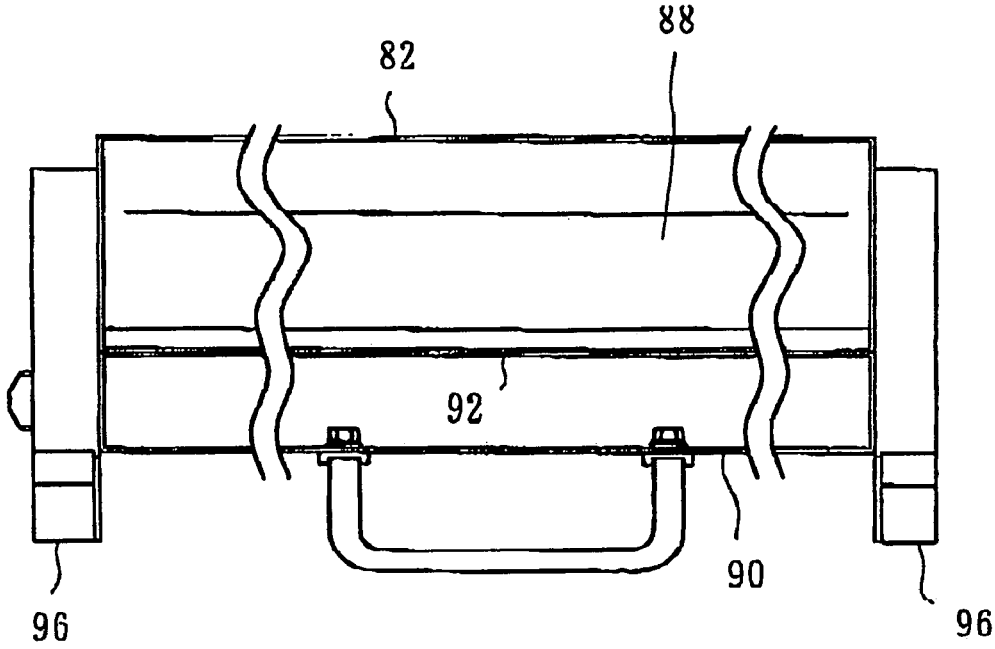
FIG. 3 is a plan view of the tray of FIG. 1.
Figure 4:
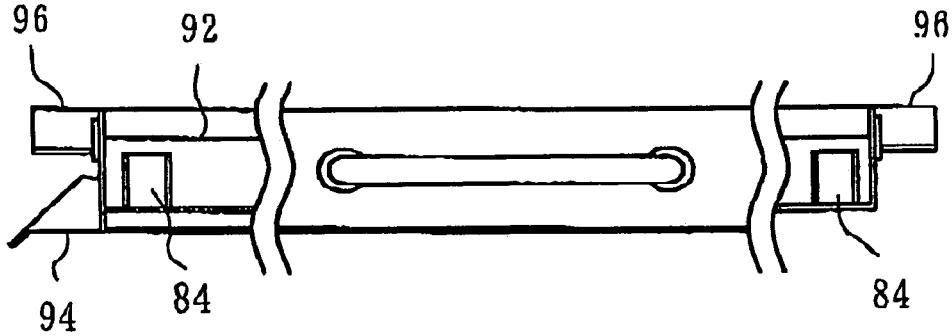
FIG. 4 is an elevational view of the tray of FIG. 3.

Furthermore, in the embodiment, the tray 82 includes a first portion 88 in which the effluent is received. The tray 82 further includes a second portion 90 disposed adjacent the first portion 88. The condensation means 80 condenses the mist into liquid which is then discharged from the condensation means 80 and received in the second portion 90. The tray 82 further includes a partition 92 disposed between the first and second portions 88 and 90. The partition 92 includes the openings 84 formed at opposite portions thereof, as shown in FIG. 3 and FIG. 4, so that the effluent can pass through the openings 84 to be discharged from the first portion 88 and received in the second portion 90 after being separated from solid or particulate material 86 by the partition 92. The solid or particulate material 86 is therefore gradually accumulated in the first portion 88.

Figure 5:
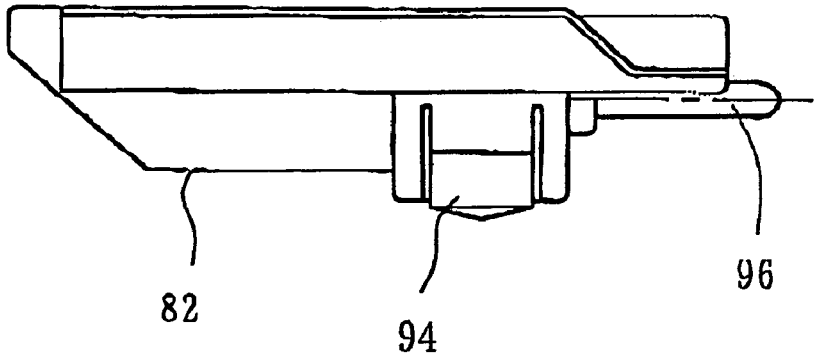
FIG. 5 is a left side view of the tray of FIG. 3.
Figure 6:
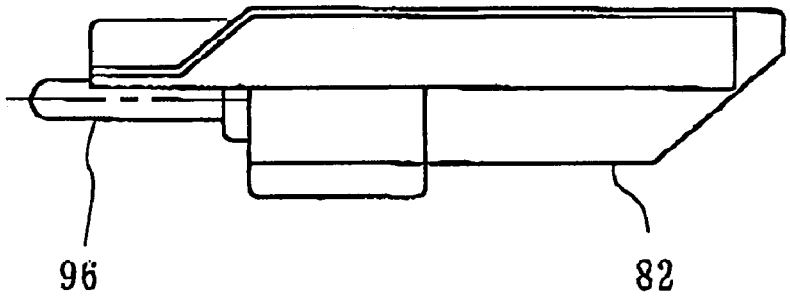

In addition, the second portion 90 includes a bottom extending between the opposite sidewalls one of which includes an outlet 94 facing downward. The bottom is inclined downward toward the outlet 94 so that the water and the effluent can flows along the bottom toward the outlet 94 to be discharged from the outlet 94. The tray 82 includes elongated portions 96, as shown in FIG. 5 and FIG. 6, which are inserted into grooves formed in the frame 24 so that the tray 82 can be mounted on the frame 24 for removal.

The tray 82 may be connected to a receptacle by means of a drainpipe to drain the effluent into the receptacle from the tray 82 through the drainpipe. In this case, no sludge is grown from the effluent and adhered to and deposited on the drainpipe by reason that the effluent contains no solid or particulate material 86 after being separated therefrom. The drainpipe is therefore hardly clogged with the sludge.

What is claimed is:

1. An apparatus for cleaning a cylinder in a printing press with cleaning liquid being supplied, the cylinder including an outer surface to which impurities are adhered, the impurities being removed from the outer surface when cleaning, the apparatus comprising:

a spray bar into which the cleaning liquid is directed with pressure, the spray bar comprising tube means which includes nozzle holes formed therein for spouting the cleaning liquid, the tube means being formed of elastic material and elastically deformed by the pressure of cleaning liquid to open the nozzle holes and spout the cleaning liquid, the tube means being elastically restored, when the cleaning liquid is not directed with pressure into the spray bar, to close the nozzle holes, said elastic material comprising polyurethane, nylon or silicon rubber, wherein the tube means comprises a plurality of tubes including the nozzle holes formed therein respectively, the tubes being arranged side by side and joined integrally with each other;

a brush roller by which the impurities are removed from the outer surface of the cylinder, at least one of the tubes including the nozzle holes orientated toward the brush roller for spouting the cleaning liquid thereon; and a flipper bar extending parallel to the brush roller, the flipper bar including a rigid portion brought into contact with the brush roller, at least one of the tubes including the nozzle holes orientated toward the rigid portion for spouting the cleaning liquid thereon.

2. The apparatus as set forth in claim 1 wherein the tube means is formed of elastic material throughout thereof.

3. The apparatus as set forth in claim 1 wherein the tube means is formed of elastic material partially to include at least a portion formed of elastic material, the nozzle holes being formed in the portion.

4. The apparatus as set forth in claim 1 wherein the nozzle holes comprise pinholes each of which is formed in the tube means by a needle piercing the tube means.

5. The apparatus as set forth in claim 1 wherein the cleaning liquid comprises solvent and/or water.

6. An apparatus for cleaning a cylinder in a printing press with cleaning liquid being supplied, the cylinder including an outer surface to which impurities are adhered, the impurities being removed from the outer surface when cleaning, the apparatus comprising:

a spray bar into which the cleaning liquid is directed with pressure, the spray bar comprising a plurality of tubes which include nozzle holes formed therein respectively for spouting the cleaning liquid, the tubes being formed of elastic material and elastically deformed by the pressure of cleaning liquid to open the nozzle holes and spout the cleaning liquid, the tubes being elastically restored, when the cleaning liquid is not directed with pressure into the spray bar, to close the nozzle holes, the tubes being arranged side by side and joined integrally with each other, the elastic material comprising polyurethane, nylon or silicon rubber;

a brush roller by which the impurities are removed from the outer surface of cylinder, at least one of the tubes including nozzle holes orientated toward the brush roller for spouting the cleaning liquid thereon;

a flipper bar extending parallel to the brush roller and having a longitudinal axis, the flipper bar having a circular cross section and including a flat surface cutting off the cross section and extending longitudinally of the flipper bar, the brush roller being rotated in a direction, the flipper bar further including a rigid portion comprising a plate fixed to the flat surface, the rigid portion extending substantially tangentially to the brush roller and including an end portion which is disposed downstream of the rigid portion in the direction and brought into contact with the brush roller; and positional adjustment means by which the flipper bar is rotated about the longitudinal axis for positional adjustment between a first position in which the rigid portion intrudes into the brush roller shallowly so that effluent can be flipped from the brush roller by the rigid portion when cleaning the cylinder, and a second position in which the rigid portion intrudes into the brush roller deeply so that the effluent can be flipped from the brush roller by the rigid portion to clean the brush roller after cleaning the cylinder, the rigid portion being kept not separated from the brush roller when being rotated into the first position and rotated into the second position, at least one of the tubes including the nozzle holes orientated toward the rigid portion for spouting the cleaning liquid thereat.

7. An apparatus for cleaning a cylinder with cleaning liquid being supplied, the cylinder including an outer surface to which impurities are adhered, the impurities being removed from the outer surface when cleaning, the apparatus comprising:

a brush roller by which the impurities are removed from the outer surface of cylinder;

a tray disposed beneath the brush roller so that effluent can be received in the tray, the effluent containing the impurities removed from the outer surface of cylinder, the tray including openings formed therein, wherein the brush roller has opposite end portions disposed at positions predetermined axially of the brush roller, the openings being formed on outsides of the positions of opposite end portions of brush roller axially of the brush roller so that the effluent can be separated into relatively clean liquid and solid or particle material, the relatively clean liquid passing through the openings to be discharged from the tray after being separated from the solid or particle material, the solid or particle material being gradually accumulated on the tray between the positions, wherein the try comprises a first portion in which the effluent is received, a second portion disposed adjacent the first portion and a partition disposed between the first and second portions, the partition including the openings formed at opposite end portions thereof so that the effluent can pass through the openings to be discharged from the first portion and received in the second portion after being separated from solid and particle material by the partition; and a spray bar into which the cleaning liquid is directed with pressure, the spray bar comprising tube means which includes nozzle holes formed therein for spouting the cleaning liquid, the tube means being formed of elastic material and elastically deformed by the pressure of cleaning liquid to open the nozzle holes and spout the cleaning liquid, the tube means being elastically restored, when the cleaning liquid is not directed with pressure into the spray bar, to close the nozzle holes.

* * * * *